United States Patent [19]

Hahn et al.

[11] 4,011,669

[45] Mar. 15, 1977

[54] POWER SCRAPER WITH APRON ON A MOVABLE PIVOT AXIS

[75] Inventors: Ray H. Hahn, Dunlap; Larry G. Eftefield, Joliet, both of Ill.

[73] Assignee: Caterpillar Tractor Co., Peoria, Ill.

[22] Filed: Dec. 24, 1975

[21] Appl. No.: 644,231

[52] U.S. Cl. ..... 37/126 AD; 37/129

[51] Int. Cl.[2] ..... E02F 5/00

[58] Field of Search ... 37/126 AD, 126 AA, 126 AB, 37/126 A, 126 R, 124, 129

[56] References Cited

UNITED STATES PATENTS

| | | | |
|---|---|---|---|
| 1,891,266 | 12/1932 | Le Tourneau | 37/126 AD |
| 2,344,313 | 3/1944 | Lichtenberg | 37/129 |
| 2,396,287 | 3/1946 | Robb | 37/126 AD |
| 2,529,848 | 11/1950 | Murray | 37/126 AD X |
| 2,642,681 | 6/1953 | Wagner | 37/126 AD X |
| 3,471,952 | 10/1969 | Peterson | 37/129 |
| 3,571,955 | 3/1971 | Eiger | 37/4 |
| 3,574,960 | 4/1971 | Peterson et al. | 37/129 X |
| 3,708,896 | 1/1973 | Eftefield | 37/126 AD X |
| 3,739,506 | 6/1973 | Klett et al. | 37/126 AA |
| 3,889,404 | 6/1975 | Eftefield | 37/126 AD |

*Primary Examiner*—E. H. Eickholt
*Attorney, Agent, or Firm*—Wegner, Stellman, McCord, Wiles & Wood

[57] ABSTRACT

A power scraper, of the type which has a bowl with a forward cutting edge and an apron which assists in the loading of the bowl, closes the loaded bowl, and is elevated for dumping, is provided with improved apron operating means. The operating means includes a translating means which shifts the apron pivot axis from an initial position that it occupies when the apron is elevated so that the path of the lower edge of the apron to closed position is forward of and below an arc of a circle struck about said initial position of the pivot axis.

10 Claims, 5 Drawing Figures

POWER SCRAPER WITH APRON ON A MOVABLE PIVOT AXIS

BACKGROUND OF THE INVENTION

High speed tractor drawn earthworking scrapers include a bowl which has sidewalls and a floor with a forward cutting edge, and an apron which is pivoted near the top of the scraper for movement between an elevated position which it occupies when the scraper is being dumped, an intermediate position somewhat above and forward of the cutting edge in which it assists with bowl loading, and a closed position against the bowl floor adjacent the cutting edge to retain a load in the bowl during transport.

Ever since the introduction of such scrapers, there have been problems with the operation of the aprons. The simplest type of apron is a one-piece plate, usually curved, having mounting arms that are pivoted on the bowl sidewalls so that the lower edge of the apron moves from elevated position to closed position in an arc of a circle struck about the axis formed by the mounting pivot. The path of approach of the lower edge of the apron during final closing is such that it is very easy for a rock to be caught between the lower edge of the apron and the bowl floor, thus preventing the apron from closing completely; and it is also not uncommon for the apron to be jammed out of contact with the bowl floor by reason of a solid mass of dirt piled on the ground below it.

U.S. Pat. No. 2,344,313 discloses one early proposal for solving the foregoing problem of apron hangup.

U.S. Pat. Nos. 3,471,952 and 3,574,960, both owned by applicant's assignee, disclose multiple articulated apron mountings the purpose of which is to alleviate the apron closing problems.

U.S. Pat. Nos. 3,739,506, also owned by applicant's assignee, discloses a two-piece scraper apron which was also developed to minimize the functional problems related to such aprons.

In general, the systems of the prior art patents are either functionally unreliable or excessively complex and expensive, or both.

SUMMARY OF THE INVENTION

The principal object of the present invention is to provide an improved apron operating means which reduces the likelihood of apron hangup and which is relatively simple, reliable, and inexpensive.

Another object of the invention is to provide an improved apron operating means which requires minimum modification of existing scraper structures.

The foregoing objects are achieved by mounting an apron upon a pivot axis which is shifted from an initial position that it occupies when the apron is elevated so as to modify the path of movement of the lower edge of the apron from an arc of a circle struck about said initial position of the pivot axis. The modification is such that initially the lower edge of the apron moves in a path that is forward to the arc of a circle, so that in its load assisting position the lower edge of the apron is forward of the position that it would occupy with simple, circular arcuate movement about the initial position of the pivot axis; while during final closing movement the path of the lower edge of the apron is below the path that it would follow in simple circular motion about the initial position of the pivot axis. This causes the apron to occupy a more favorable position during loading, and also causes it to follow a path during final closing which reduces the likelihood of hangup by causing the lower edge of the apron to move generally longitudinally in a clean, shearing action along the upper part of earth that is piled up ahead of the cutting edge.

THE DRAWINGS

Figure 2:
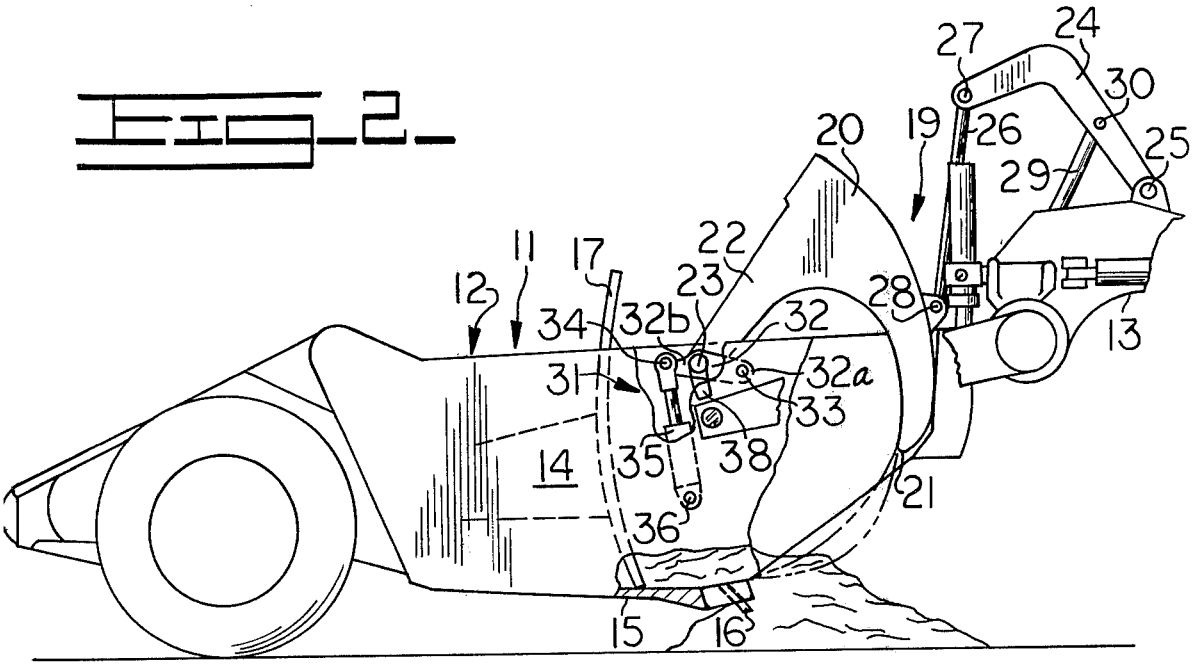
FIG. 2 is a fragmentary side elevational view on an enlarged scale and partially in section, showing a first embodiment of the present invention.
Figure 4:
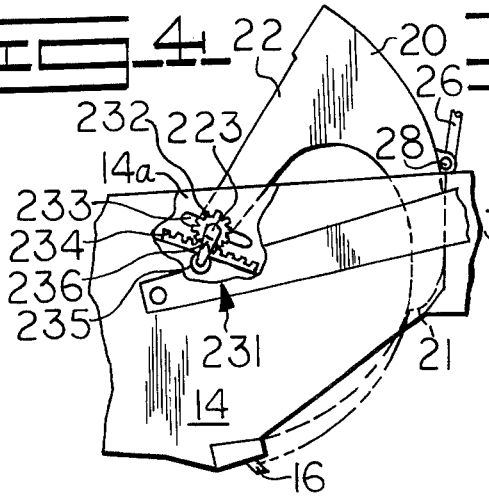
FIG. 4 is a fragmentary side elevational view, with a part broken away, illustrating another embodiment of the invention.
Figure 5:
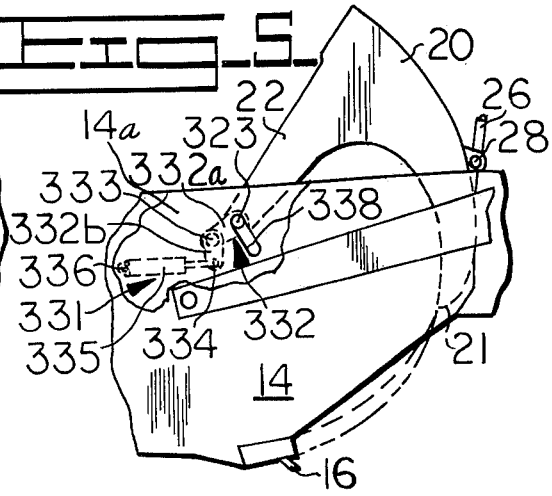
FIG. 5 is a view similar to FIG. 4 showing yet another embodiment of the invention.

In each of FIGS. 2, 4 and 5 a dash line traces the path of the lower end of the apron from elevated to closed position if its pivot axis remained at the initial position that it occupies when the apron is elevated; and a line of short and long dashes indicates the path actually followed by the lower end of the apron due to the shifting of the pivot axis.

DETAILED DESCRIPTION OF THE INVENTION

Figure 1:
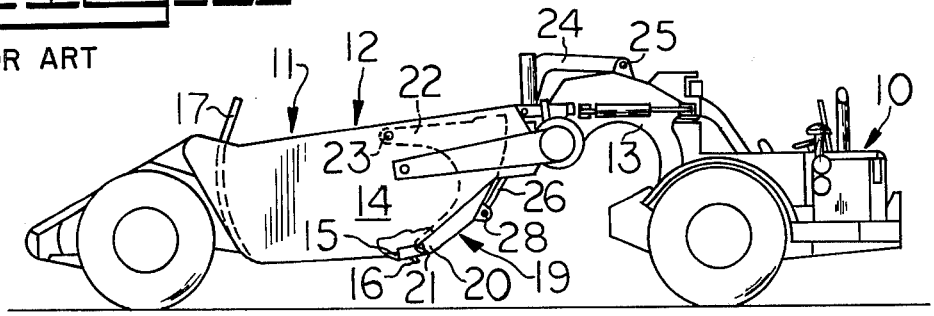
Fig. 1 PRIOR ART
FIG. 1 is a side elevational view of a power scraper of the type in which the invention is used.
Figure 3:
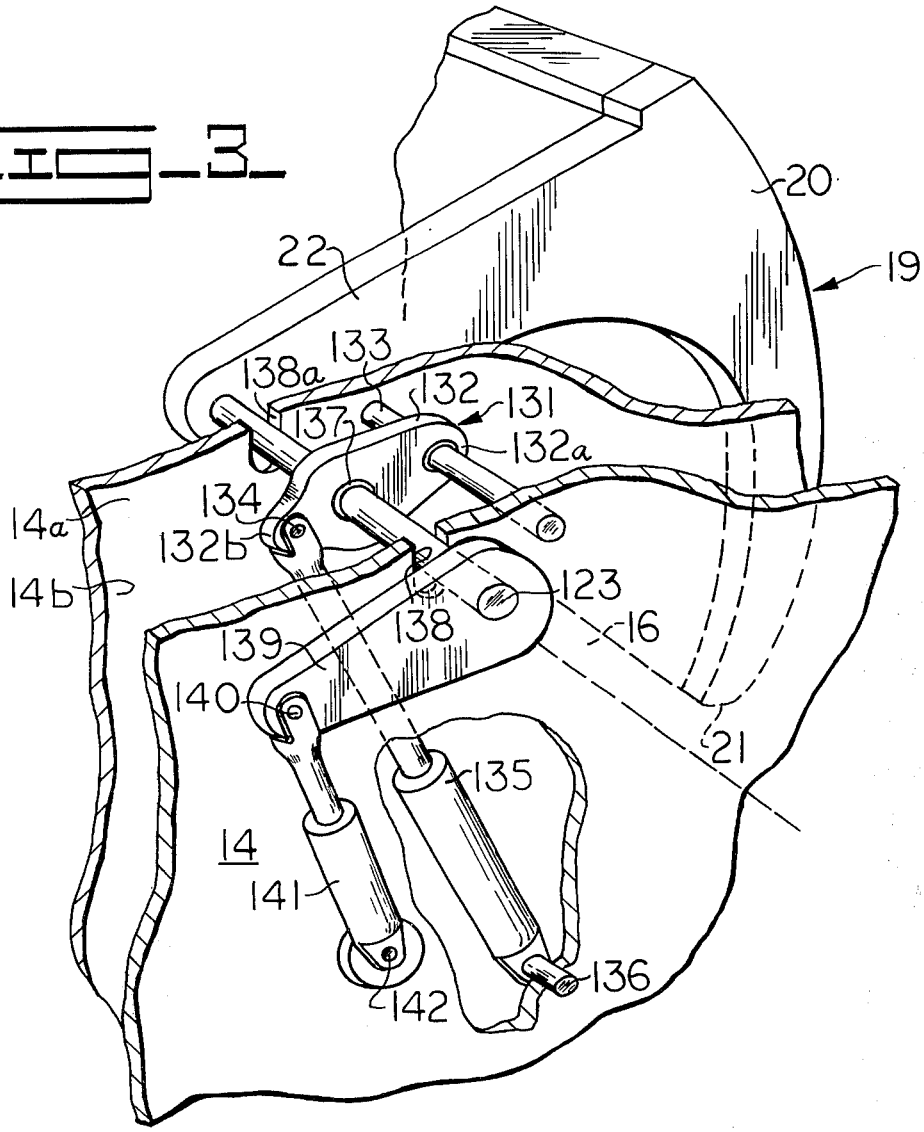
FIG. 3 is a fragmentary, perspective view on an enlarged scale which discloses a modification of the embodiment of FIG. 2.

Referring to FIG. 1, a power scraper includes a tractor, indicated generally at 10; and a scraper indicated generally at 11, which includes a bowl, indicated generally at 12, and a gooseneck 13 which is pivotally connected to the tractor 10 in the usual fashion. The bowl has upright sidewalls 14 and a floor 15 at the front margin of which is a blade providing a forward cutting edge 16. As seen in FIG. 3, spaced inwardly from each of the walls 14 of the bowl is an interior wall **14*a* which is parallel to the wall 14 so as to provide an inter-wall space 14*b*. an ejector 17** is illustrated in the drawings in a normal position at the rear of the bowl from which it is moved forward by a hydraulic cylinder means (not shown) to eject material from the bowl.

Apron means, indicated generally at 19, includes a transversely extending, curved plate 20 which has a lower edge 21, and the plate 20 has mounting arms 22 at its two sides by means of which the apron is mounted in the sidewalls 14 and interior walls **14*a* upon aligned pivots 23 which provide a pivot axis about which the apron is moved between an elevated position illustrated in FIG. 2 and a closed position illustrated in FIG. 1. The apron means 19 includes a lever 24 which is pivoted at 25 on the gooseneck 13, a link 26 which is pivotally connected to the outer end of the lever at 27 and to a boss on the apron at 28, and a hydraulic cylinder and piston 29 which is pivoted (not shown) on the gooseneck and which is also pivotally connected at 30 to the lever 24**.

When the apron is mounted on a fixed pivot axis as illustrated in FIG. 1, the lower edge 21 of the apron follows the path which is illustrated in dash lines of equal length in FIG. 2 which is, of course, an arc of a circle struck about the pivot axis 23.

Referring now more particularly to FIG. 2, in accordance with the present invention the operating means for the apron 20 includes translating means which is operatively connected to the apron and to the sidewalls of the bowl for shifting the apron pivot axis from the initial positon illustrated in FIG. 2, so that as the apron is moved its lower end 21 follows a modified path which is indicated in FIGS. 2, 4 and 5 by the lines having dashes of unequal length. In the apparatus of FIG. 2, the translating means, which is indicated generally at 31, includes a pair of axially aligned levers, such as the lever 32, each of which has one end 32*a* journalled upon a pin 33. As seen in FIG. 3, where the corresponding elements are numbered 131, 132, 132*a* and 133, each pin is mounted between a sidewall 14 and an interior sidewall 14*a* so that the levers 32 and 132 are in the inter-wall space 14*b*.

At the other end 32*b* of each of the levers 32 is a pin 34 to which is pivotally connected a yoke that is on the piston rod of a hydraulic cylinder 35 the other end of which is pivotally mounted upon a pin 36 which is between the sidewall 14 and the interior sidewall 14*a*.

The pivot 23 which supports the apron 20 is journalled in the levers 32, between the pins 33 and 34, and extends through aligned slots 38 which are formed in the interior sidewalls 14*a*.

When the apron 20 is in the elevated position illustrated in FIG. 2 the pivot axis 23 occupies an initial position which is the same as that illustrated in FIG. 1, and the piston rod of the hydraulic cylinder 35 is fully extended. As the hydraulic cylinder 29 is retracted to move the apron 20 from the elevated position of FIG. 2 to the closed position of FIG. 1 the piston rod of the piston 35 is also retracted to shift the pivot axis 23 downwardly in the slots 38 thus causing the lower end 21 of the apron 20 to follow the path indicated by the long and short dash lines in FIG. 2.

FIG. 3 discloses a modification of the apparatus of FIG. 2 in which the more conventional lever 24, link 26 and hydraulic cylinder 29 are eliminated, and the pivot 123 which provides the pivot axis for the apron, which extends through a slot 138*a* in the interior wall 14*a*, is also extended outwardly through a slot 138 in the sidewall 14 to receive a crank arm 139. At the outer end of the arm 139 is a pin 140 to pivotally receive a yoke on the end of a piston rod of a hydraulic cylinder 141 which is pivoted at 142 on the sidewall 14. In the modification of FIG. 3, the piston rod of the cylinder 141 is fully retracted when the apron 20 is in its elevated position, and is fully extended when the apron is in its closed position.

In FIG. 3, as indicated by the relative positions of the cutting edge 16 and the lower end of the apron 21, the apron is substantially in the position that it occupies during a loading operation, when it is above and somewhat forward of the cutting edge 16 so as to cause a layer of material which may be 8 or 10 inches deep to enter the bowl 12 while the upper portion of the material, if the cutting edge has taken a deeper cut than that, is pushed forwardly by the lower end portion of the apron.

The apparatus of FIG. 3 is identical with the apparatus of FIG. 2 except for the fact that the apron 20 is moved by the piston 141 acting through the arm 139, rather than by the piston 29 acting through the lever 24 and the rod 26.

Referring now to FIG. 4, a pair of pivots such as the pivot 223 for an apron 20 are provided with translating means which is indicated generally at 231. The translating means 231 includes a spur gear 232 which is fixed to the pivot 223 outside the interior sidewall 14*a*, with the pivot extending through a slot 233 in said interior wall. Secured to the interior wall parallel to the slot 233 is a gear rack 234 which is engaged by the pinion 232; and engagement between the rack and pinion is maintained by a roller 235 which is journalled on an arm 236 that is rigidly fixed to the outer end portion of the pivot 223, with the roller 235 engaged beneath the rack 234.

As indicated by the link 26 and pivot 28 in FIG. 4, movement of the apron 20 is provided by the same piston and lever arrangement seen in FIG. 1 and 2, and when the apron is moved toward closed position the pinion 232 rolls down the rack 234 to shift the pivot axis provided by the pivots 223.

In the apparatus of FIG. 5 pivots 323 on the ends of the apron arms 22 are shifted by a translating means which is indicated generally at 331. The translating means 331 includes a bell crank 332 which is journalled upon a pin 333 that is mounted in the sidewall 14 and the interior wall 14*a*. The pivot 323 is journalled in a first arm 332*a* of the bell crank 332; while a second arm 332*b* of the bell crank makes a pivotal connection 334 with a piston rod of a hydraulic cylinder 335 which is also pivoted at 336 on the sidewall 14.

As the apron 20 is moved by the force exerted by the rod 26 the pivot axis provided by the pivots 323 shifts around the pin 333 upon which the bell crank 332 is mounted. Thus, the apparatus of FIG. 5 is very similar to that of FIG. 2 except for the fact that the pivot 323 is journalled in an arm of a bell crank (a lever of the first class) instead of being in a lever of the second class. The pivot 323 extends through an arcuate slot 338 in the interior wall 14*a*.

The foregoing detailed description is given for clearness of understanding only and no unnecessary limitations should be understood therefrom, as modifications will be obvious to those skilled in the art.

We claim:

1. An improved apron operating means for a power scraper which includes a tractor and a scraper with a bowl that has sidewalls and a floor provided with a forward cutting edge, and an apron mounted for movement about a pivot axis near the top of the scraper between an initial, elevated, unloading position, a closed position with its lower edge against the bowl floor immediately adjacent the cutting edge, and an intermediate loading position with said lower edge in a plane above the cutting edge, said operating means comprising, in combination:

hydraulic cylinder means pivotally connected to the scraper and to the apron for moving the apron about said pivot axis between its elevated position and its closed position;

and translating means operatively connecting the apron to the sidewalls of the bowl for automatically and continuously shifting said pivot axis a short distance downwardly from an initial position during the entirety of said moving the apron about the pivot axis so that the path of the lower edge of the apron from elevated position toward intermediate position is forward of an arc of a circle struck about said initial positon of the axis, and said path from intermediate position to closed position is below said arc.

2. The combination of claim 1 in which the translating means includes a pair of aligned levers co-axially pivoted on the sidewalls, the pivots forming the pivot axis are mounted on the levers, and control means for rotating said levers during movement of the apron.

3. The combination of claim 2 in which the control means comprises a pair of hydraulic cylinders, each operatively connected to one of the levers and to a sidewall.

4. The combination of claim 3 in which the levers are bell cranks, the pivots forming the pivot axis are mounted on one arm of each bell crank and the control cylinders are connected to the other arm of each bell crank.

5. The combination of claim 3 in which each lever has one of its ends pivoted on a sidewall, the control cylinders are connected to the other ends of the levers, and the pivots forming the pivot axis are journalled in the levers between said ends.

6. The combination of claim 2 in which the levers are bell cranks, the pivots forming the pivot axis are mounted on one arm of each bell crank, and the control means is operatively connected to the other arm of each bell crank and to sidewall.

7. The combination of claim 2 in which each lever has one of its end pivoted on a sidewall, the control means is operatively connected to the other end of each lever, and the pivots forming the pivot axis are journalled in the levers between said ends.

8. The combination of claim 1 in which the translating means includes a forwardly and downwardly inclined toothed rack on each sidewall, and a pinion fixed to each side of the apron on the pivot axis, said pinions engaging said racks to move therealong as the apron is moved about said axis.

9. The combination of claim 1 in which the translating means includes movable means on which the pivots forming the pivot axis are carried, and control means operatively connected to said movable means and to the bowl sidewalls to confine the movement of said movable means to a predetermined path.

10. The combination of claim 1 in which the translating means shifts the pivot axis a short distance forwardly as well as downwardly.

* * * * *